US008684867B2

(12) United States Patent
Murphy

(10) Patent No.: US 8,684,867 B2
(45) Date of Patent: Apr. 1, 2014

(54) GOLF TEE REWINDING DEVICE

(75) Inventor: Thomas Murphy, Blackrock (IE)

(73) Assignee: Thomas Murphy, Dublin (IE)

( * ) Notice: Subject to any disclaimer, the term of this patent is extended or adjusted under 35 U.S.C. 154(b) by 0 days.

(21) Appl. No.: 13/261,404

(22) PCT Filed: Feb. 17, 2011

(86) PCT No.: PCT/IE2011/000012
§ 371 (c)(1),
(2), (4) Date: Aug. 20, 2012

(87) PCT Pub. No.: WO2011/107974
PCT Pub. Date: Sep. 9, 2011

(65) Prior Publication Data

US 2013/0005511 A1 Jan. 3, 2013

(30) Foreign Application Priority Data

Mar. 5, 2010 (IE) ..... 2010/0145

(51) Int. Cl.
*A63B 57/00* (2006.01)

(52) U.S. Cl.
USPC ..... 473/387; 273/DIG. 21; 224/918

(58) Field of Classification Search
USPC ..... 473/386–403, 408; 224/918; 273/DIG. 21; D21/719, 721
See application file for complete search history.

(56) References Cited

U.S. PATENT DOCUMENTS

| | | | | | |
|---|---|---|---|---|---|
| 1,552,991 | A | * | 9/1925 | Jones | 473/393 |
| 1,562,744 | A | * | 11/1925 | Dillow | 473/396 |
| 1,610,720 | A | * | 12/1926 | Walton | 473/394 |
| 1,839,040 | A | * | 12/1931 | McCarrier | 473/392 |
| 3,744,801 | A | * | 7/1973 | Morritt | 473/396 |
| 4,114,878 | A | * | 9/1978 | Hammond | 473/394 |
| 4,151,937 | A | * | 5/1979 | Jarosh et al. | 224/666 |
| 4,336,940 | A | * | 6/1982 | Sprague | 473/393 |
| 5,172,839 | A | * | 12/1992 | Frisbie | 224/251 |
| 5,720,677 | A | * | 2/1998 | Rudduck | 473/387 |
| 5,782,708 | A | * | 7/1998 | Kimball, Jr. | 473/408 |
| 6,095,934 | A | * | 8/2000 | Ohama | 473/408 |
| 6,491,594 | B1 | * | 12/2002 | Dacosta | 473/408 |
| 6,679,793 | B2 | * | 1/2004 | Joo | 473/393 |
| D643,494 | S | * | 8/2011 | Book | D21/793 |
| 2009/0209369 | A1 | * | 8/2009 | Smith et al. | 473/406 |

FOREIGN PATENT DOCUMENTS

| | | | | | |
|---|---|---|---|---|---|
| GB | 2411123 | A | * | 8/2005 | A63B 57/00 |

* cited by examiner

*Primary Examiner* — Steven Wong

(74) *Attorney, Agent, or Firm* — Maier & Maier, PLLC

(57) ABSTRACT

Rewindable golf tee. This includes a small rewinding device encased in a smooth edged multifarious holder with dampened press control element or pull to stop, pull to rewind system to safely rewind a golf tee via a strong flexible quality link. The aid can have two tees of varied lengths to suit golf club selection, two rewinding devices and two flexible connections. It can be cheap or expensive. The invention can support other golf gadgets such as pitch-mark repairer, ball marker, groove cleaner and/or score keeper. The invention can hold personal ID or corporate logo or advertisement. The invention is environmentally friendly. The tees can be made of more durable materials, with new special integrated finishes such as soft grip patterns. They can be easily replaced via connecting links. The rewindable tee device will sensibly save time on the tee box and avoid clutter in bags, pockets and/or greens.

3 Claims, 6 Drawing Sheets

Fig. 2a
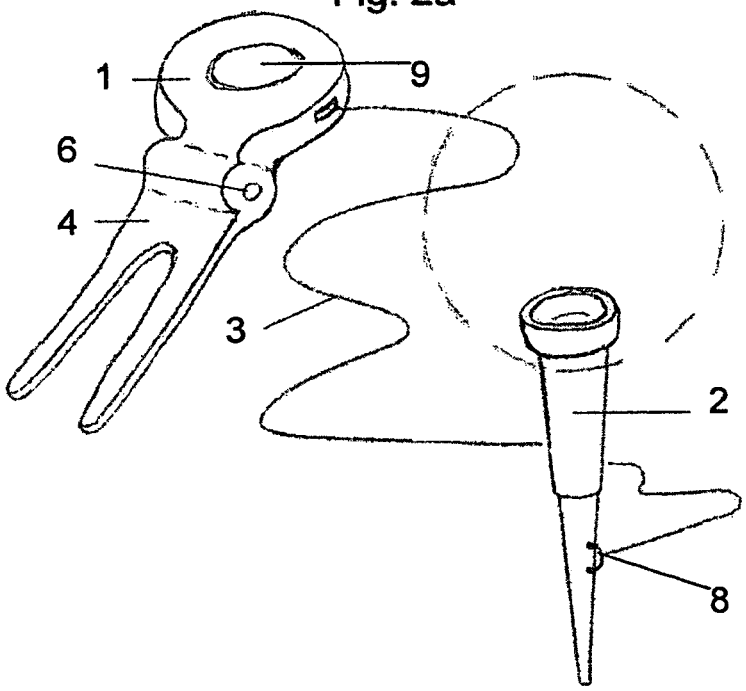
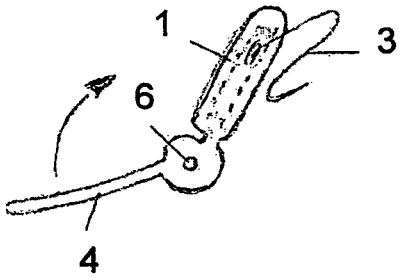
Fig. 2b
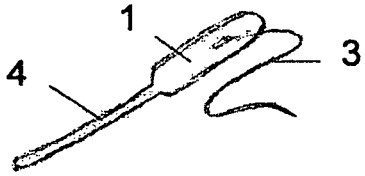
Fig. 2c

GOLF TEE REWINDING DEVICE

FIELD OF THE INVENTION

The present invention relates to golf equipment. In particular the invention relates to a golf tee rewinding device.

BACKGROUND OF THE INVENTION

Irish patent no. S58907 for Golf Etee by inventor Thomas Murphy, which operates on a similar principle. Since this invention, rewinding devices have become more elaborate. They have dampeners which can regulate the recoiling process and enable a secure rewinding procedure. This golf tee rewinding device incorporates such line retraction units.

To-date, golf tees are still sold as loose items which can be easily lost. The primary function of this invention is to prevent golfers from losing their golf tees. With this invention, the tee is connected to a basic anchor rewinding device and it cannot fly away. The same tee can be used repeatedly or can be replaced by others of varying sizes to suit the golfer.

At present loose tees are cheap because they are made of wood or plastic. Wood is biodegradable but plastic takes a long time to degrade. Both materials can break easily so a tee's life expectancy tends to be very short. Loose tees can also get lost easily.

The tees for this device can be made of durable materials as for example, gold, silver, platinum or other metals which could be engraved and/or decorated. Such hard materials will be buffered from the club face at impact by suitable protective strips. The tee can also be made of cheaper materials as for example ebony, bone, plastic, wood etc. The tee can now become a more personalised item and an element to cherish. The tee can easily be replaced on the recoil line when desired or when necessary with for example a screw on cap. The tee is kept in retracted position by a tightly wound coil in a housing. During usage of the tee, the cable is unwound to the appropriate setting/cable length. At the end of use the tee cable is recoiled into the holder via a dampened recoiling process.

STATEMENT OF INVENTION

Accordingly, there is a rewinder unit comprising: a boxed in recoiler, which allows the cable to wind onto a protected reel in a dampened and controlled safe motion. Considering elements of design safety, the rewinder housing box can vary in shape, colour and material. The cable type, length and finish can also vary. The cable can exit from any point on the housing box to suit varied designs. The unit can also be designed to accommodate two tees of varying sizes which would each have its own link and recoiler. The unit could also hold other elements such a pitch-mark repairer, ball markers, a groove cleaner, and/or a score keeper-pen.

The recoil device and its tee can become an object of collection, of commemoration, a golf prize, a site of polarity for corporation advertisement or simply a great present.

The tee of the invention can be of high quality, more versatile in shape and promote advertising.

The rewinder and tee can either or both be made in expensive or cheap materials. They can be made of diverse shapes, colours and materials

BRIEF DESCRIPTION OF THE DRAWINGS

FIG. 2 *a,b* and *c* show a golf tee rewinder with pitch mark repair element. FIG. 2*a* shows a golf tee rewinder which contains a recoiling element 1 with a flexible link connection 3, attached to a tee 2 by means of a connector 8. A ball position marker can be attached on either side of the unit magnetically or otherwise. In this design the recoil casing supports a pitch-mark repairer 4. The pitch mark repairer can either be of solid structure as per FIG. 2*c* or it can fold as per FIG. 2*b* with the help of a hinge 6 to facilitate storage.

FIGS. 3*a*, 3*b*, 3*d* and 3*e* show the golf tee retracted into its support housing 7 with a ball position marker 9 attached, magnetically or otherwise, on one side or both sides of the housing.

FIG. 3*d* shows a housing 7 with a recoiled tee 2, a position marker 9 and a pitch-mark repairer 4 turned into storage position.

FIG. 3*e* shows an open pitch-mark repair element 4. The hole 5 on the pitch repair is a thumb hole. It can be included to facilitate the opening of the pitch mark but is not an essential element.

FIGS. 4*a*, 4*b*, 4*d* and 4*e* show tees rewound into their housing 7. A ball position marker 9 can be attached magnetically or otherwise on one or on both sides of the housing.

FIG. 4*d* and FIG. 4*e* show a golf rewinder device where the tees 2 are wound into their housing. In FIG. 4*d* the pitch-mark repairer 4 is folded into storage position. In FIG. 4*e* it is opened out to carry out pitch-mark repairs.

DETAILED DESCRIPTION OF THE INVENTION

Figure 1:
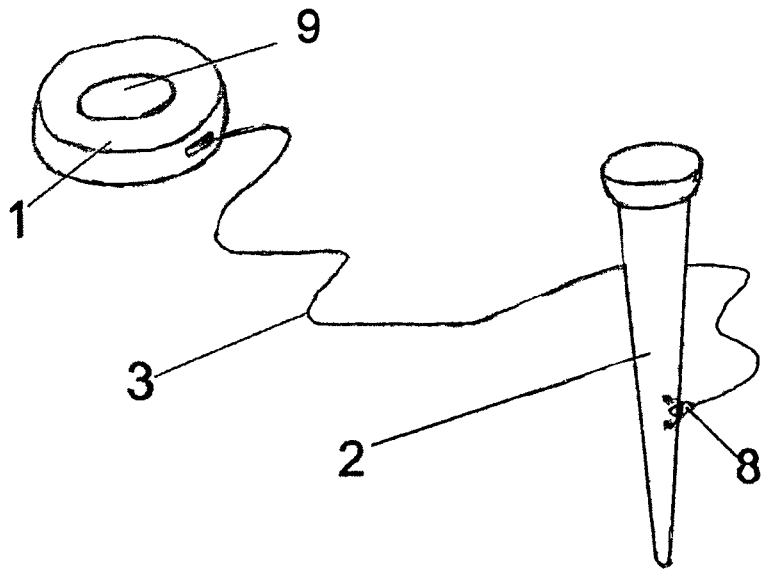
FIG. 1 A golf tee rewinder which contains a recoiling element 1, with a flexible link connection 3, attached to a tee 2 by means of a seal 8; with a ball position marker 9 attached magnetically or otherwise to the control element.
Figure 3A:
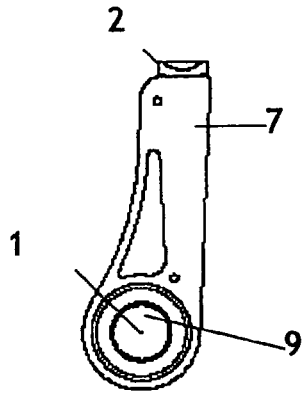
FIG. 3*a* shows a golf tee recoiling element 1 enclosed in a housing 7, where a golf tee 2 and its connection link are also integrated.
Figure 3B:
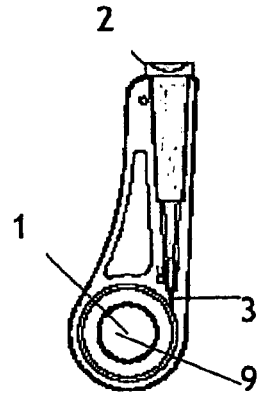
Figure 3C:
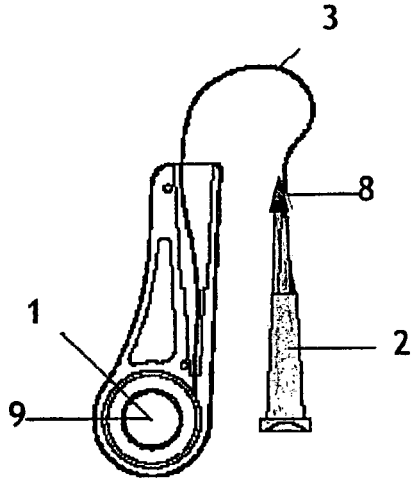
FIG. 3*c* shows a replaceable tee 2 with openable connection 8 unwound out of its support housing 7.
Figure 3D:
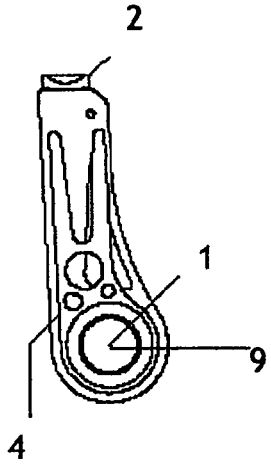
Figure 3E:
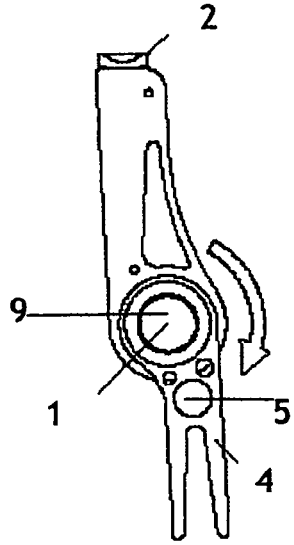
Figure 4A:
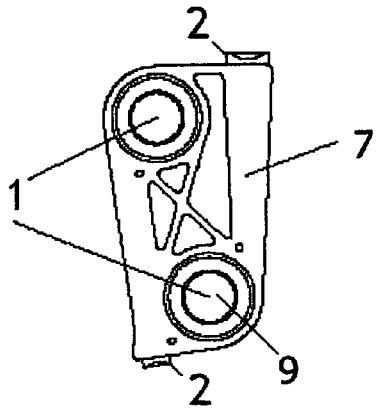
FIG. 4*a* shows the same elements as FIG. 3*a* but in this case, the housing contains two recoiling elements with a replaceable tee attached to each through an openable connection 8. The tees can be detachable. They could be of the same length or of a different lengths to befit the use of a driving tee and an iron tee for example.
Figure 4B:
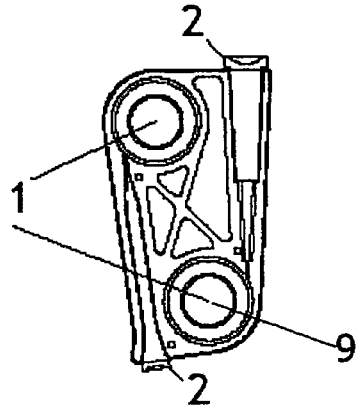
Figure 4C:
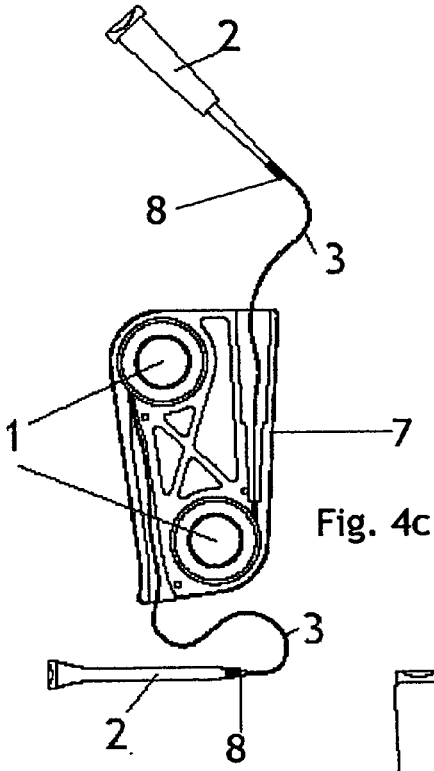
FIG. 4*c* shows a golf rewinder device where both tees 2 are unwound out of their housing 7. The connection element 8 allows easy replacement of tees.
Figure 4D:
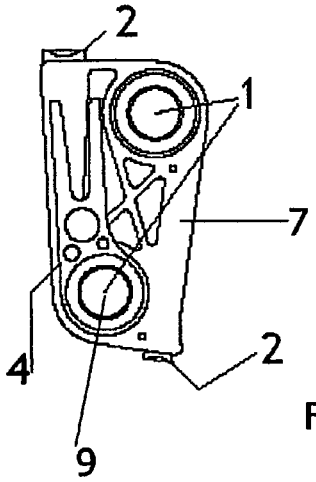
Figure 4E:
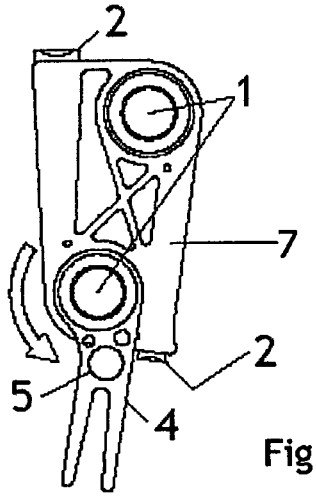

The invention provides for a golf tee 2, securely attached to a flexible link 3 which is connected to a recoiling element 1. The tee can either:

a) recoil to an basic anchor FIG. 1 and be outside the unit. This anchor frame can hold one or two ball markers 9 which could have corporate logos b) recoil to an anchor which is fitted with one or two ball markers and a retractable pitch repair tool FIG. 2*a*, FIG. 2*b*, FIG. 2*c* which locks into open position to avoid injury. The tee remains outside the unit.

c) recoil into an anchor housing FIG. 3*b* and FIG. 3*c*. which can contain either one recoiling element and one connected tee FIG. 3B and FIG. 3*c* or contain two recoiling elements with their associated tee and connection FIG. 4*c*. The tees can be of the same length or of different lengths, such as a tee for irons and a tee for drivers. The overall housing 7 can facilitate fittings for other golfing elements such as ball markers 9, a pitch repairer 4, a groove cleaner or a score keeper.

Figure 5A:
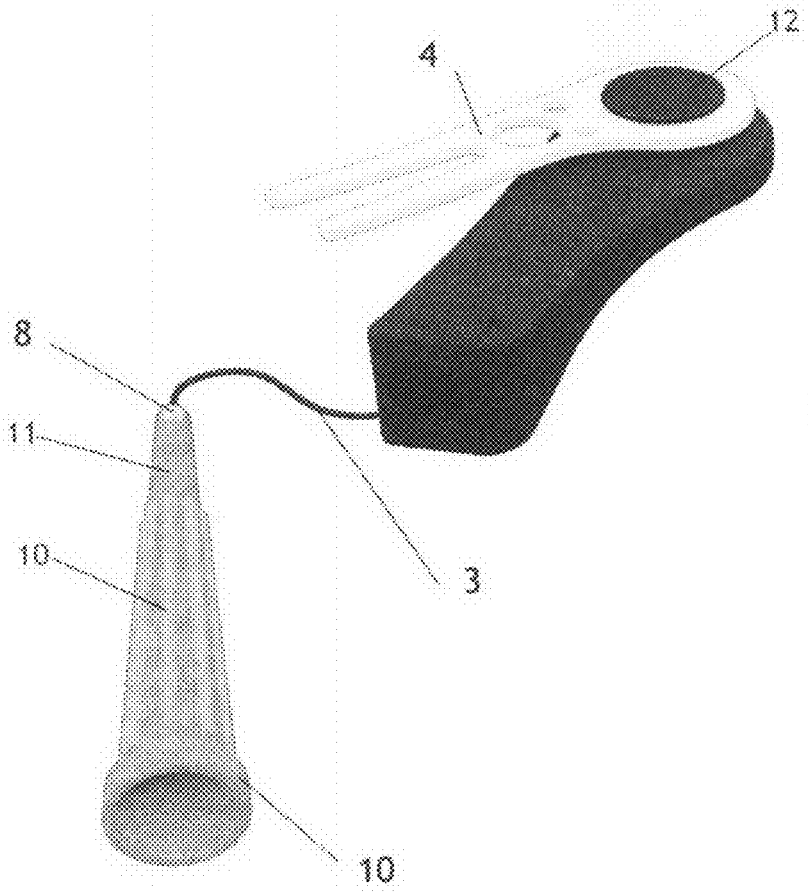
FIG. 5*a* shows a replaceable tee 11 with impact absorbtion elements 10 and a screw on connector 8 and an alternative position for the control button/ball marker 12.
Figure 5B:
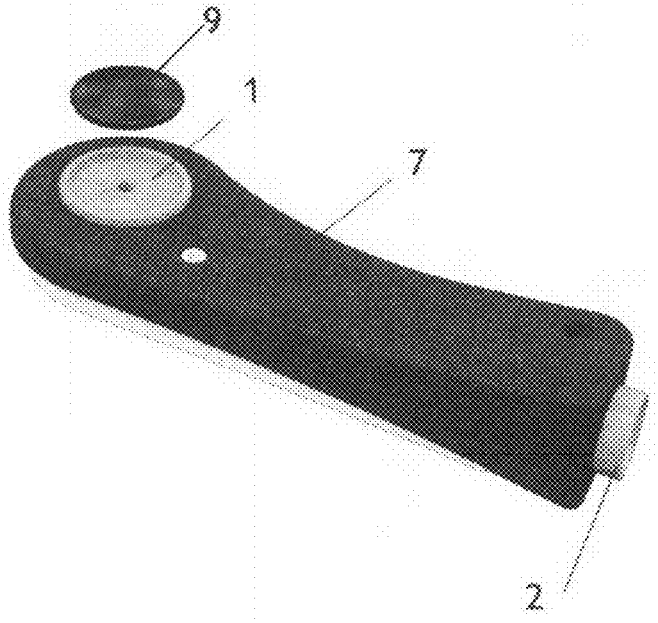
FIG. 5*b* shows a single rewinding device 7 with a control button 1 onto which a ball position marker 9 is magnetically attached.
Figure 6:
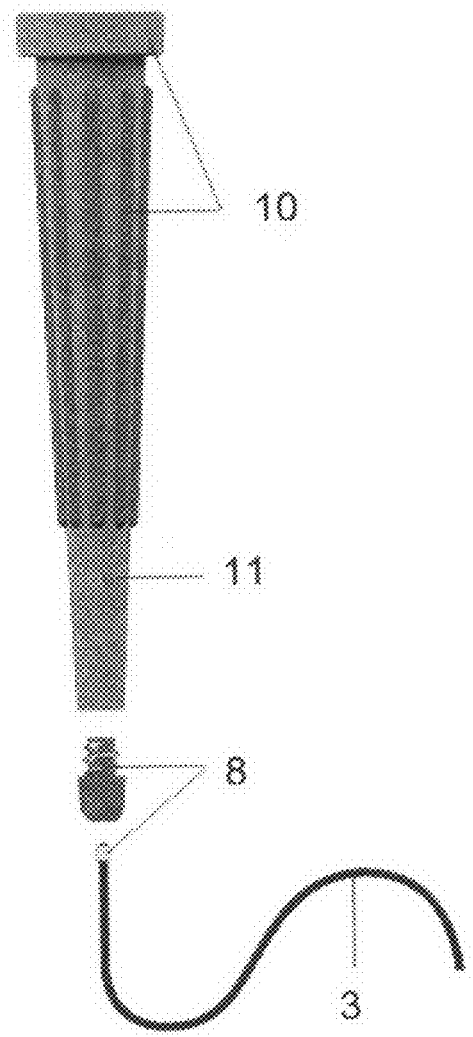
FIG. 6 shows a replaceable tee 11 with impact absorbtion elements 10, the connector element 8 and the flexible link 3.

The complete housing 7 incorporates new tees with special features. The tees are fitted with a connector which facilitates their removal and replacement 8 FIG. 6 and FIG. 5*a*. They are manufactured with impact absorbtion elements 10 FIG. 6 to the side and to the rim. The tees can be manufactured to various sizes and shapes to suit a golfer's personal preferences.

The anchor, which can either be positioned on the ground or be put into the ground using the pitch-mark repairer, contains a control rewinding device 1. To use the selected tee, the golfer pulls it out, unwinding the link cable, sets it into the ground whilst leaving a safe distance from the anchor to freely take his strike. At the end of his strike, the golfer presses the dampener control touch button or lever to rewind his tee smoothly back to its holder. With a more basic recoil system the golfer would give a small tug to the cord to make it rewind into the holder.

The golf tee 11. It can be made in a variety of different materials such as gold, silver, platinum, wood, bone, plastic, coconut shell, etc. It may have integrated impact protective buffers/strips as required.

The link or flexible connection. It can be made from materials such as wire, nylon, carbon thread or any strong suitable lightweight material. It can either have an openable joint connection at either end to the actual tee and to the anchor for easy removal in case of wear and tear or it can be sealed directly inside the tee or linked to it at various points.

The anchor casing 7. It can be made in a variety of materials from cheap to expensive and can incorporate corporate logos. It should have a smooth shape finish and texture so as to facilitate easy storage in a trouser pocket and avoid any possibility of injury through misuse.

The rewinding device 1. Its shape, size and colour can be varied. The size will vary in function of the length and thickness of the rewindable thread and the size of the housing desired. In all cases, the rewinding device can incorporate a dampener to control the speed of the rewinding procedure and make it safe for the user. It will also have a controllable pull and stop motion so as to be able to control the winding and unwinding of the tee for safety.

The invention claimed is:

1. A golf tee rewinding device, comprising:

a golf tee;

a metal cap removably coupled to said golf tee by way of a threaded connector located proximate to the tip of the golf tee;

a housing which is able to accommodate the golf tee and comprises a rewinder therein; and a cord, both ends of which are connected to the metal top and the rewinder, wherein the rewinder is able to rewind the cord and wherein the golf tee is stored in the housing from the tip direction when the cord is rewound by the rewinder.

2. The golf tee rewinding device as claimed in claim 1, wherein the housing is able to accommodate a plurality of golf tees and the same number of rewinders as the plurality of golf tees, the golf tee rewinding device further comprising a plurality of metal tops connected to a tip of each golf tee with a screw, and a plurality of cords, both ends of each cord connected to each of the plurality of the metal tops and the plurality of the rewinders.

3. The golf tee rewinding device as claimed in claim 1 or 2, wherein the housing further comprises at least one of: a pitch repairer and a ball position marker.

* * * * *